US010480494B2

(12) United States Patent
Strong

(10) Patent No.: US 10,480,494 B2
(45) Date of Patent: Nov. 19, 2019

(54) RUNAWAY VALVE SYSTEM FOR A PUMP

(71) Applicant: Carlisle Fluid Technologies, Inc., Charlotte, NC (US)

(72) Inventor: Christopher Lee Strong, Frederick, CO (US)

(73) Assignee: Carlisle Fluid Technologies, Inc., Scottsdale, AZ (US)

( * ) Notice: Subject to any disclaimer, the term of this patent is extended or adjusted under 35 U.S.C. 154(b) by 331 days.

(21) Appl. No.: 15/196,007

(22) Filed: Jun. 28, 2016

(65) Prior Publication Data

US 2016/0377074 A1 Dec. 29, 2016

Related U.S. Application Data

(60) Provisional application No. 62/186,220, filed on Jun. 29, 2015.

(51) Int. Cl.
*F04B 9/125* (2006.01)
*F04B 23/02* (2006.01)
(Continued)

(52) U.S. Cl.
CPC ..... *F04B 9/125* (2013.01); *B05B 9/0409* (2013.01); *B05B 12/08* (2013.01); *F04B 23/028* (2013.01);
(Continued)

(58) Field of Classification Search
CPC ..... F04B 49/02; F04B 49/10; F04B 49/03; F04B 23/028; F04B 49/065;
(Continued)

(56) References Cited

U.S. PATENT DOCUMENTS 3,452,645 A * 7/1969 Barltrop ..... B64C 13/00 91/1
3,965,927 A 6/1976 Siczek
(Continued)

FOREIGN PATENT DOCUMENTS

EP 2273114 A1 1/2011
GB 878072 A 9/1961
(Continued)

OTHER PUBLICATIONS

Best Pneumatics Transmitters, SMC, 2005, CAT.ES12-7A, SMC Corporation, Japan, 21 pages.
(Continued)

*Primary Examiner* — Devon C Kramer
*Assistant Examiner* — David N Brandt
(74) *Attorney, Agent, or Firm* — Fletcher Yoder, P.C.

(57) ABSTRACT

A system includes a pump. The pump includes a piston configured to axially reciprocate within a body. The axial movement of the piston activates a first chamber valve and a second chamber valve. The system also includes a main valve configured to direct a flow to the pump to facilitate the axial movement which then transfers a fluid from a reservoir to a spray applicator. The system includes a runaway valve system fluidly coupled to the main valve and configured to detect a runaway state of the pump. The runaway valve system is configured to direct the main valve to stop operation of the pump in response to detection of the runaway state.

18 Claims, 8 Drawing Sheets

(51) Int. Cl.

| | |
|---|---|
| ***F04B 49/03*** | (2006.01) |
| ***F04B 49/06*** | (2006.01) |
| ***B05B 9/04*** | (2006.01) |
| ***B05B 12/08*** | (2006.01) |
| ***F04B 49/02*** | (2006.01) |
| ***F04B 49/10*** | (2006.01) |

(52) U.S. Cl.
CPC ..... *F04B 49/02* (2013.01); *F04B 49/03* (2013.01); *F04B 49/065* (2013.01); *F04B 49/10* (2013.01); *F04B 49/103* (2013.01); *F04B 2201/0201* (2013.01); *F04B 2203/09* (2013.01); *F04B 2203/10* (2013.01); *F15B 2211/8755* (2013.01)

(58) Field of Classification Search
CPC ..... F04B 2201/0201; F04B 2203/09; F04B 2203/10; F04B 9/125; B05B 9/0409; B05B 12/08; F15B 20/00; F15B 20/005; F15B 2211/8755
See application file for complete search history.

(56) References Cited

U.S. PATENT DOCUMENTS

| | | | | |
|---|---|---|---|---|
| 4,080,987 | A * | 3/1978 | Fogg | F16K 17/00 137/464 |
| 4,830,046 | A | 5/1989 | Holt | |
| 4,976,281 | A | 12/1990 | Berglund | |
| 5,174,722 | A | 12/1992 | Lybecker | |
| 5,222,518 | A | 6/1993 | Fisher et al. | |
| 6,409,142 | B1 | 6/2002 | Kariya et al. | |
| 7,603,855 | B2 | 10/2009 | Strong | |
| 8,584,453 | B2 | 11/2013 | Skoog | |
| 8,640,729 | B2 | 2/2014 | Dana | |
| 8,757,208 | B2 | 6/2014 | Dornbach et al. | |
| 9,677,549 | B2 * | 6/2017 | Bauck | F04B 9/125 |
| 9,677,550 | B2 * | 6/2017 | Bauck | F04B 9/125 |
| 2005/0022660 | A1 | 2/2005 | Holland | |
| 2008/0250918 | A1 * | 10/2008 | Strong | B05B 7/0093 91/275 |

FOREIGN PATENT DOCUMENTS

| | | | |
|---|---|---|---|
| JP | S61-178576 | A1 | 8/1986 |
| JP | 61-178576 | U | 11/1986 |
| WO | 2008/124217 | A1 | 10/2008 |

OTHER PUBLICATIONS

PCT International Search Report & Written Opinion; Application No. PCT/US2016/040164; dated Sep. 19, 2016; 12 pages.
Chinese Office Action for CN Application No. 201680049188.6 dated Nov. 29, 2018, 18 pgs.
Australian Examination Report No. 1 for AU Application No. 2016287501 dated Dec. 18, 2018, 3 pgs.
Japanese Office Action for JP Application No. 2017-568022 dated Jan. 29, 2019, 5 pgs.
Chinese Office Action for CN Application No. 201680049188.6 dated Aug. 21, 2019, 6 pages.

* cited by examiner

RUNAWAY VALVE SYSTEM FOR A PUMP

CROSS REFERENCE TO RELATED APPLICATION

This application claims priority to and benefit of U.S. Provisional Patent Application No. 62/186,220, entitled "Runaway Valve System for a Pump", filed Jun. 29, 2015, which is herein incorporated by reference in its entirety.

BACKGROUND

The present disclosure relates generally to sprayers, and more particularly, to a runaway valve system for a pneumatic pump supplying fluid to a sprayer.

Sprayers, such as spray guns, may be used to apply a coating material to a wide variety of target objects. Certain spray guns use a pneumatic pump to drive the coating material from a reservoir toward a spray nozzle tip. Unfortunately, the pump and reservoir may be positioned away from an operator using the spray gun, therefore monitoring of the level of coating material in the reservoir may be difficult. Operation of the pump without coating material may lead to a runaway pump condition, where the pump does not pump coating material but rapidly pumps air, which can increase the rate of wear of the pump.

BRIEF DESCRIPTION

Certain embodiments commensurate in scope with the originally claimed disclosure are summarized below. These embodiments are not intended to limit the scope of the claimed disclosure, but rather these embodiments are intended only to provide a brief summary of possible forms of the disclosure. Indeed, the disclosure may encompass a variety of forms that may be similar to or different from the embodiments set forth below.

A system includes a pump. The pump includes a piston configured to axially reciprocate within a body. The axial movement of the piston activates a first chamber valve and a second chamber valve. The system also includes a main valve configured to direct a flow to the pump to facilitate the axial movement which then transfers a fluid from a reservoir to a spray applicator. The system includes a runaway valve system fluidly coupled to the main valve and configured to detect a runaway state of the pump. The runaway valve system is configured to direct the main valve to stop operation of the pump in response to detection of the runaway state.

A runaway valve system includes a housing and a signal valve positioned within the housing. The signal valve is configured to receive a first signal from a pump indicative of a first piston position, and a second signal from the pump indicative of a second piston position. The system also includes a control valve configured to receive a third signal from the signal valve indicative of a runaway state.

A system includes a pump configured to pump a fluid from a reservoir to a spray applicator. The system also includes an air supply configured to facilitate operation of the pump. The air supply is configured to output a volume of air. The system further includes a main valve configured to receive the volume of air from the air supply and to distribute the volume of air to the pump to enable axial reciprocation within a body to control operation of the pump. Additionally, the system includes a runaway valve system configured to receive a first signal from the pneumatic pump indicative of a first axial position of the pump and a second signal from the pump indicative of a second axial position of the pump. The runaway valve system determines if the pump is operating in a runaway state, and stops operation of the pump if the pump is operating in the runaway state.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Furthermore, top, bottom, upward, downward, upper, lower, or the like may be construed as relative terms that relate, in context, to the orientation, position, or location of the various components of the disclosure. Indeed, presently disclosed embodiments may be applicable to any runaway valve system having the same or different configuration and/or orientation described above and in detail below.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

Embodiments of the present disclosure are directed toward a runaway valve system that blocks a pump system from operating in a runaway condition or state (e.g., running without pumping fluid, a runaway condition). The runaway valve system is configured to receive first and second signals (e.g., pneumatic signals) from a pump (e.g., from valves positioned in the pump, from sensors positioned proximate to the pump). For example, the pump may include an upper chamber valve configured to output a first signal (e.g., upper chamber signal or upstroke signal) indicative of an upstroke, and a lower chamber valve configured to output a second signal (e.g., lower chamber signal or downstroke signal) indicative of a downstroke. The runaway valve system uses the first and second pneumatic signals to determine whether the pump is operating in the runaway state. If the runaway valve system detects a runaway state, the runaway valve system outputs a third signal (e.g., runaway signal) to a main air valve configured to stop operation of the pump.

Figure 1:
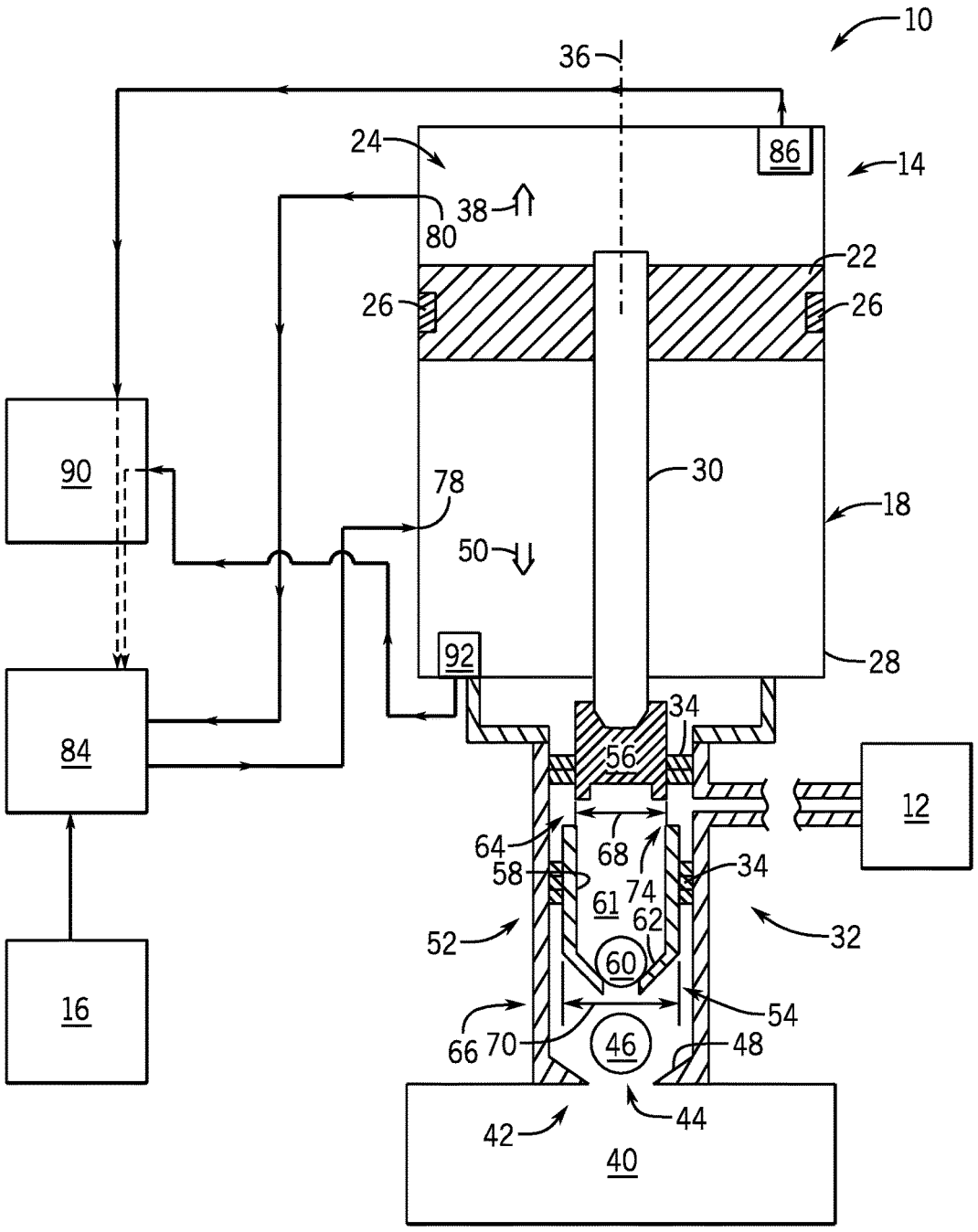
FIG. 1 is a schematic cross-sectional view of an embodiment of a pumping system with a pump in a first position.

FIG. 1 is a schematic cross-sectional view of an embodiment of a pumping system 10 that conveys a liquid and/or powder spray coating material (e.g., paint, stain, sealant, etc.) to a spray applicator 12 (e.g., spray gun). While the illustrated embodiment includes the spray application 12, in other embodiments, the pumping system 10 may be used to circulate a fluid, in a series of pumping systems, or the like. In the illustrated embodiment, the pumping system 10 includes a motor section 14 (e.g., an air section, a pneumatic motor, a hydraulic motor) operated via air pressure from an air supply 16 (e.g., an air tank or an air compressor). For example, air from the air supply 16 may be directed to a lower chamber 18 (e.g., a second chamber) of the motor section 14 via a conduit (e.g., tubing, piping) and a control valve (e.g., a main air valve). However, in other embodiments, the motor section 14 may be operated via different types of gas (e.g., an inert gas) or by fluid (e.g., water, hydraulic oil, etc.). As will be appreciated, in certain embodiments, various piping fittings, valves, meters, and the like may be positioned between the air supply 16 and the lower chamber 18. For example, the main air valve (e.g., an electronic controller) may be positioned between the air supply 16 and the lower chamber 18 to regulate the flow of air from the air supply 16 to the lower chamber 18. The control valve may be an electronic controller which includes a processor and/or memory (e.g., RAM, ROM, or any non-transitory machine readable medium). As shown, a piston 22 separates the lower chamber 18 from an upper chamber 24 (e.g., a first chamber). In the illustrated embodiment, the piston 22 includes piston seals 26 positioned between the piston 22 and a body 28 (e.g., a cylinder) of the motor section 14. The piston seals 26 may contact the body 28, thereby forming a fluid-tight or semi-fluid-tight seal between the piston seals 26 and the body 28 to separate of the lower chamber 18 and the upper chamber 24. As a result, a force (e.g., air pressure) applied to the piston 22 in the lower chamber 18 drives movement of the piston 22. As will be appreciated, movement of the piston 22 changes the volume of the upper and lower chambers 24, 18. Moreover, the piston 22 is coupled to a motor section rod 30 (e.g., rod) extending through the lower chamber 18 to a fluid section 32. In the illustrated embodiment, the lower chamber 18 is separated from the fluid section 32 via rod seals 34 distributed circumferentially about the rod 30. The rod seals 34 are configured to fluidly isolate the lower chamber 18 from the fluid section 32, and to enable movement of the rod 30 along a pump axis 36.

During operation, the air supply 16 supplies air (e.g., via a pump or a valve configuration) to the lower chamber 18 via the main air valve, thereby exerting a force against the piston 22 (e.g., a pressure in the lower chamber 18 greater than a pressure in the upper chamber 24). The force drives the piston 22 upward in an axial direction 38 along the pump axis 36. As described above, because the rod 30 is coupled to the piston 22, upward movement of the piston 22 is translated to the rod 30. In other words, the rod 30 moves in the same direction as the piston 22. As will be described below, the rod 30 is configured to couple to a lower rod section positioned within the fluid section 32 to draw coating material (e.g., fluid) out of the reservoir 40.

The fluid section 32 includes a first check valve 42 at an inlet 44 coupled to the reservoir 40. In the illustrated embodiment, the reservoir contains the coating material being moved to the spray gun 12. As used herein, the coating material and/or fluid may refer to a gas, a solid (e.g., a powder), a liquid, or any combination thereof. In the illustrated embodiment, the first check valve 42 is a ball check valve having a first ball 46 configured to rest on a first seat 48 (e.g., annular seat) while a force (e.g., gravity, fluid pressure, air pressure) acts on the first ball 46 downward in an axial direction 50. Movement of the piston 22 upward in the axial direction 38 may lift the first ball 46 in the upward axial direction 38 and away from the first seat 48, thereby opening the inlet 44 of the fluid section 32. As a result, the coating material may flow out of the fluid reservoir 40.

In the illustrated embodiment, the fluid section 32 also includes a fluid section rod 52 coupled to the rod 30. In the illustrated embodiment, the fluid section rod 52 includes a second check valve 54. In the illustrated embodiment, the fluid section rod 52 comprises a first rod section 56 and a second rod section 58. As shown, the first rod section 56 is closer to the motor section 14 than the second rod section 58. The first rod section 56 is coupled to the rod 30, thereby facilitating motion of the fluid section rod 52 within the fluid section 32 via axial movement of the piston 22. As shown, the second check valve 54 is a ball check valve having a second ball 60 that is configured to seal off a passage 61 (e.g., annular passage) within the fluid section rod 52 while the second ball 60 is positioned on a second seat 62 (e.g., annular seat). Movement of the piston 22 upward in the axial direction 38 is configured to drive the second ball 60 onto the second seat 62, while movement of the piston 22 downward in the axial direction 50 is configured to lift the second ball 60 off of the second seat 62, thereby enabling the coating material to enter the passage 61. Furthermore, as shown in the illustrated embodiment, the rod seals 34 are positioned about the fluid section rod 52, separating the fluid section 32 into a top section 64 (e.g., within or substantially within the passage 55) and a bottom section 66 (e.g., outside of or substantially outside of the passage 55). As will be described below, fluid in the top section 64 is driven toward the spray gun 12 by movement of the piston 22 downward in the axial direction 50 and upward in the axial direction 38.

In the illustrated embodiment, the first rod section 56 is coupled to the second rod section 58. Moreover, the first rod section 56 has a smaller diameter 68 than a diameter 70 of the second rod section 58. Accordingly, the fluid section rod 52 may be referred to as a rod having various diameters. Furthermore, the fluid section rod 52 includes an opening 74 configured to enable the coating material to exit the passage 61 and to flow toward the spray gun 12. In certain embodiments, one or more check valves may be positioned between the opening 74 and the spray gun 12 to control flow of the coating material to the spray gun 12.

In operation, the air from the air supply 16 enters the lower chamber 18 through a lower chamber port 78 and drives the piston 22 upward in the axial direction 38. Movement of the piston 22 upward in the axial direction 38 decreases the volume of the upper chamber 24 and drives exhaust (e.g., air) out of the upper chamber 24 via an upper chamber port 80. The exhaust from the upper chamber port 80 may be directed to a main air valve 84 (e.g., a main valve). From the main air valve 84, the exhaust may be vented (e.g., to atmosphere). As the piston 22 moves upward in the axial direction 38, drawing coating material into the fluid section 32, the piston 22 may encounter an upper chamber valve 86 (e.g., a first chamber valve) at a top of the upstroke. In the illustrated embodiment, the upper chamber valve 86 is a poppet valve that provides a signal (e.g., an air signal) to the main air valve 84 and to a runaway valve system 90. For example, the signal may be indicative of the position of the piston 22 within the body 28, thereby signaling the main air valve 84 to direct air to the upper chamber 24 as the piston 22 reaches the top of the upstroke. While the upper chamber valve 86 is a poppet valve in the illustrated embodiment, in other embodiments different sensors may be utilized to provide the signal to the main air valve 84 and/or the runaway valve system 90. For example, the upper chamber valve 86 may be a proximity sensor, magnetic sensor, or the like configured to determine the position of the piston 22 within the body 28. Furthermore, in other embodiments, the position of the piston 22 may be determined by sensors positioned within the fluid section 32. For example, magnetic switches may be positioned along the fluid section 32 to determine the relative position of the fluid section rod 52. As will be described below, the upper chamber valve 86 (or other types of sensors) may be configured to send the air signal to the runaway valve system 90 to control operation of the pumping system 10.

Figure 2:
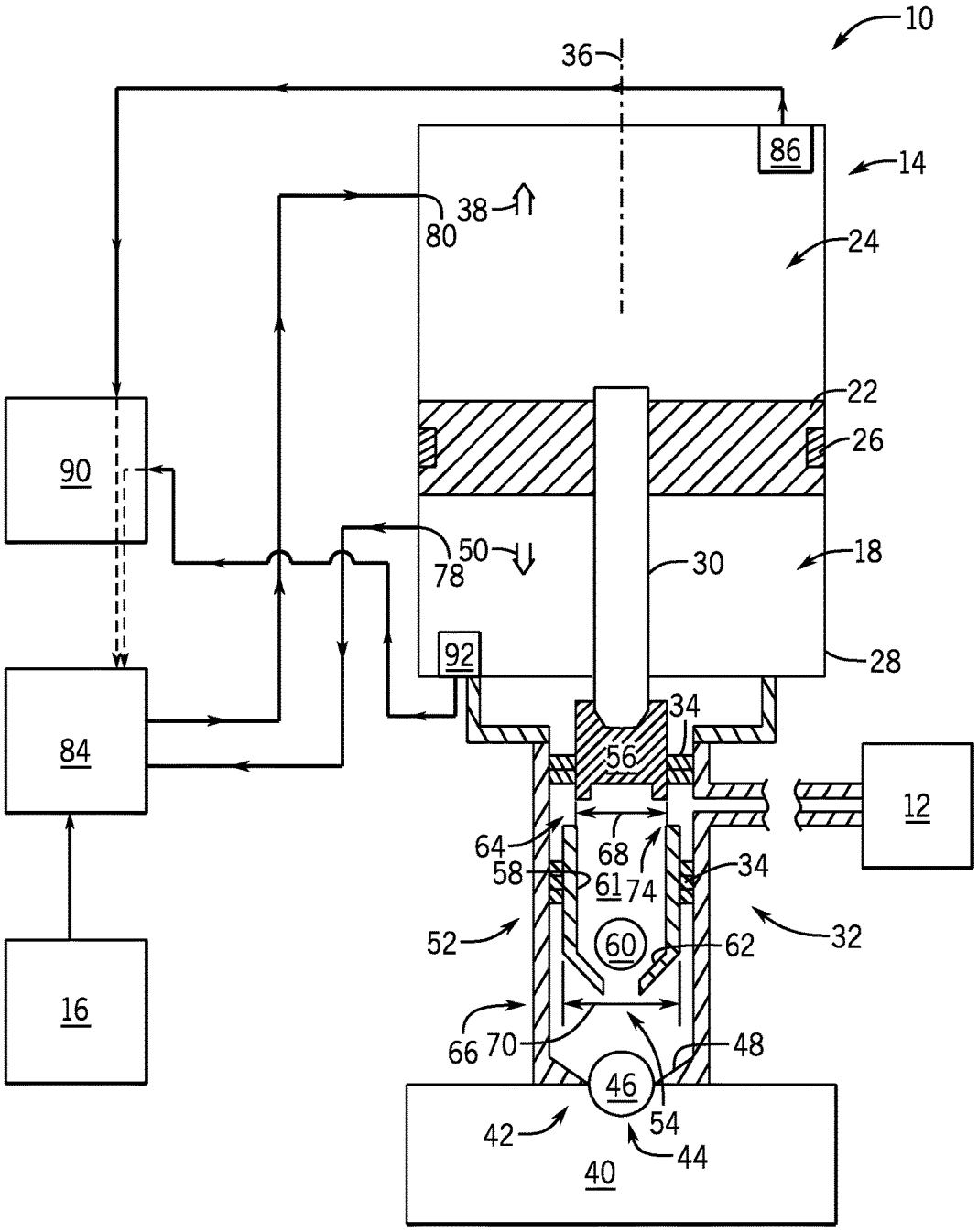
FIG. 2 is a schematic cross-sectional view of an embodiment of the pumping system of FIG. 1, with the pump in a second position.

FIG. 2 is schematic cross-sectional view of an embodiment of the pumping system 10 in which the piston 22 is in a second position. In the illustrated embodiment, the air supply 16 directs air into the main air valve 84 and the upper chamber 24 via the upper chamber port 80. The air enters the upper chamber 24 and the air applies a force to the piston 22 (e.g., the air increases the pressure in the upper chamber 24), driving the piston 22 downward in the axial direction 50. As a result, the air in the lower chamber 18 is driven out of the lower chamber 18 via the lower chamber port 78. As described above, various control systems, valving, or piping configurations may be utilized to open the lower chamber port 78 to enable exhaust to exit the lower chamber 18. Moreover, movement of the piston 22 downward in the axial direction 50 along the pump axis 36 drives the rod 30 downward in the axial direction 50, thereby driving the second rod 52 downward in the axial direction 50. As a result, the second ball 60 is lifted off the second ball seat 62 as the fluid chamber 32 is pressurized by the movement of the piston 22. Moreover, downward movement of the piston 22 may drive the fluid toward the opening 74 due to the increased pressure in the fluid section 32.

Furthermore, movement of the piston 22 downward in the axial direction 50 may activate a lower chamber valve 92 (e.g., a second chamber valve). For example, the lower chamber valve 92 may be a poppet valve that sends a pneumatic signal (e.g., air signal) to the runaway valve system 90 and the main air valve 84 indicative of a position of the piston 22 at a bottom of the downstroke. However, as described above, in other embodiments various sensors (e.g., electrical, magnetic, optical, etc.) may be utilized to send the signal to the main air valve 84 and/or the runaway valve system 90. Accordingly, the main air valve 84 may direct air toward the lower chamber 18 in response to the signal from the lower chamber valve 92. In this manner, upward and downward movement of the piston 22 may drive the fluid from the fluid reservoir 40 toward the spray gun 12.

Figure 3:
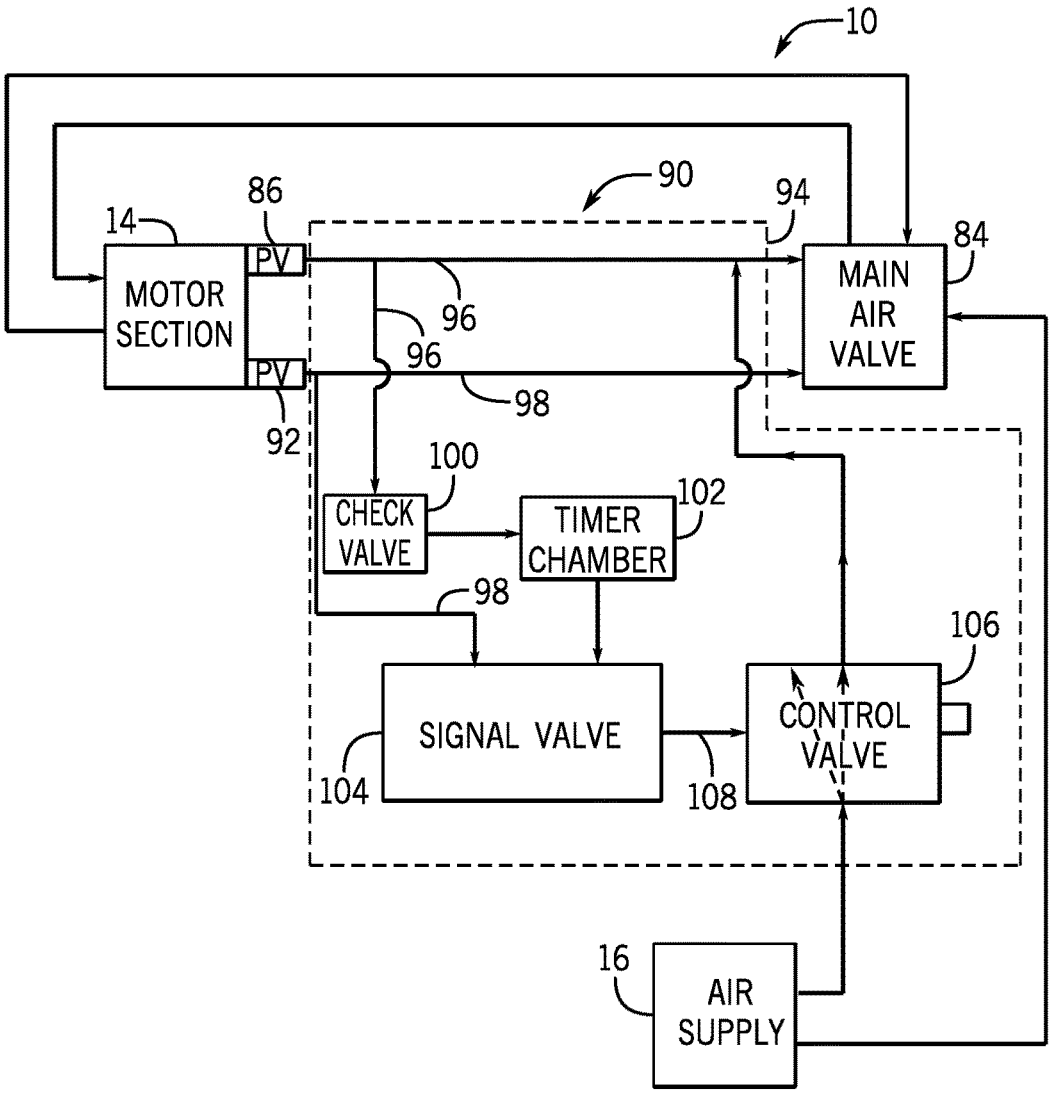
FIG. 3 is a block diagram of an embodiment of the pumping system of FIG. 1 with a runaway valve system.

FIG. 3 is a schematic diagram of an embodiment of the pumping system 10. In the illustrated embodiment, the runaway valve system 90 is positioned between the motor section 14 and the main air valve 84. For example, in certain embodiments the runaway valve system 90 may include a housing 94 configured to couple to the motor section 14 and the main air valve 84. In some embodiments, the housing 94 may be configured to couple to existing pumping systems 10. In other words, the housing 94 may be retro-fit into existing units.

As described above, the motor section 14 includes the upper chamber valve 86 and the lower chamber valve 92. However, in other embodiments, sensors may be positioned within the fluid section 32 to monitor operation of the motor section 14. In operation, the upper chamber valve 86 sends an upper chamber signal 96 (e.g., a first chamber signal, an air signal, an electronic signal, a magnetic signal, an optical signal, etc.) to the main air valve 84 upon activation by the piston 22. For example, the upper chamber valve 86 may send a signal indicative of the position of the piston 22 along the stroke of the motor section 14 (e.g., the upstroke). Based on the upper chamber signal 96 from the upper chamber valve 86, the main air valve 84 may direct air from the air supply 16 toward the upper chamber 24 to drive the piston 22 downward in the axial direction 50. As will be explained in detail below, the upper chamber signal 96 may also be utilized by the runaway valve system 90 to block operation of the motor section 14 when a runaway state is detected. Similarly, the lower chamber valve 92 outputs a lower chamber signal 98 (e.g., a second chamber signal, an air signal, an electronic signal, a magnetic signal, an optical signal, etc.) to the main air valve 84. The main air valve 84 also utilizes the lower chamber signal 98 to distribute the air from the the air supply 16 to the lower chamber 18 to drive the piston 22 upward in the axial direction 38.

In the illustrated embodiment, the runaway valve system 90 includes a fourth check valve 100, a timer chamber 102, a signal valve 104, and a control valve 106. As used herein, the signal valve 104 refers to a relay or transmission valve (e.g., an AND valve) configured output a signal based on at least two input signals received by the signal valve 104. Additionally, as used herein, the control valve 106 refers to a valve configured to enable flow from a specified port upon receipt of a signal (e.g., an air signal, an electronic signal, a magnetic signal) and to continue to enable flow from the specified port until reset by an operator (e.g., manually or electronically). As shown, the fourth check valve 100 is configured to receive the upper chamber signal 96 from the upper chamber valve 86. The fourth check valve 100 enables flow to the timer chamber 102 while blocking flow back to the upper chamber valve 86. For example, the fourth check valve 100 may be a ball check valve, a spring-loaded check valve, or the like. While the illustrated embodiment includes one fourth check valve 100, in other embodiments there may be 2, 3, 4, 5, or any suitable number of check valves positioned between the timer chamber 102 and the upper chamber valve 86.

Furthermore, the fourth check valve 100 may be communicatively coupled (e.g., fluidly, electronically) to the timer chamber 102. For example, a conduit may be positioned between the fourth check valve 100 and the timer chamber 102 to transfer the volume of air associated with the upper chamber signal 96 into the timer chamber 102. The timer chamber 102 is configured receive and store a pre-defined volume of air. For example, the timer chamber 102 may include a cavity having an inlet, an outlet, and a vent. As will be described below, the timer chamber 102 may be configured to vent the volume of air at a predetermined rate (e.g., a predetermined time interval) configured to correspond to the upstroke and the downstroke of the motor section 14. In other words, the vent may be configured to release the volume of air from the timer chamber 102 at a rate that enables the timer chamber 102 to be substantially empty before the lower chamber signal 98 is sent to the signal valve 104 after a full stroke of the motor section 14, during normal operation of the motor section 14.

In the illustrated embodiment, the timer chamber 102 is coupled to the signal valve 104. As will be described in detail below, the signal valve 104 selectively blocks flow to the control valve 106. For example, the signal valve 104 blocks flow to the control valve 106 while receiving flow from only a first signal valve inlet or only a second signal valve inlet. However, the signal valve 104 enables flow to the control valve 106 while receiving flow from both the first and second signal valve inlets. In the illustrated embodiment, the upper chamber signal 96 is directed toward the valve 104 through the timer chamber 102 while the lower chamber signal 98 is directed directly toward the signal valve 104. As a result, the signal valve 104 is configured to receive at least both of the upper chamber signal 96 and the lower chamber signal 98 and to output a runaway signal 108 (e.g., a volume of air) to the control valve 106, upon receipt of both signals within the time limit set by the timer chamber 102, during a runaway state. As will be described below, the control valve 106 is configured to block operation of the motor section 14 during a runaway state.

Figure 4:
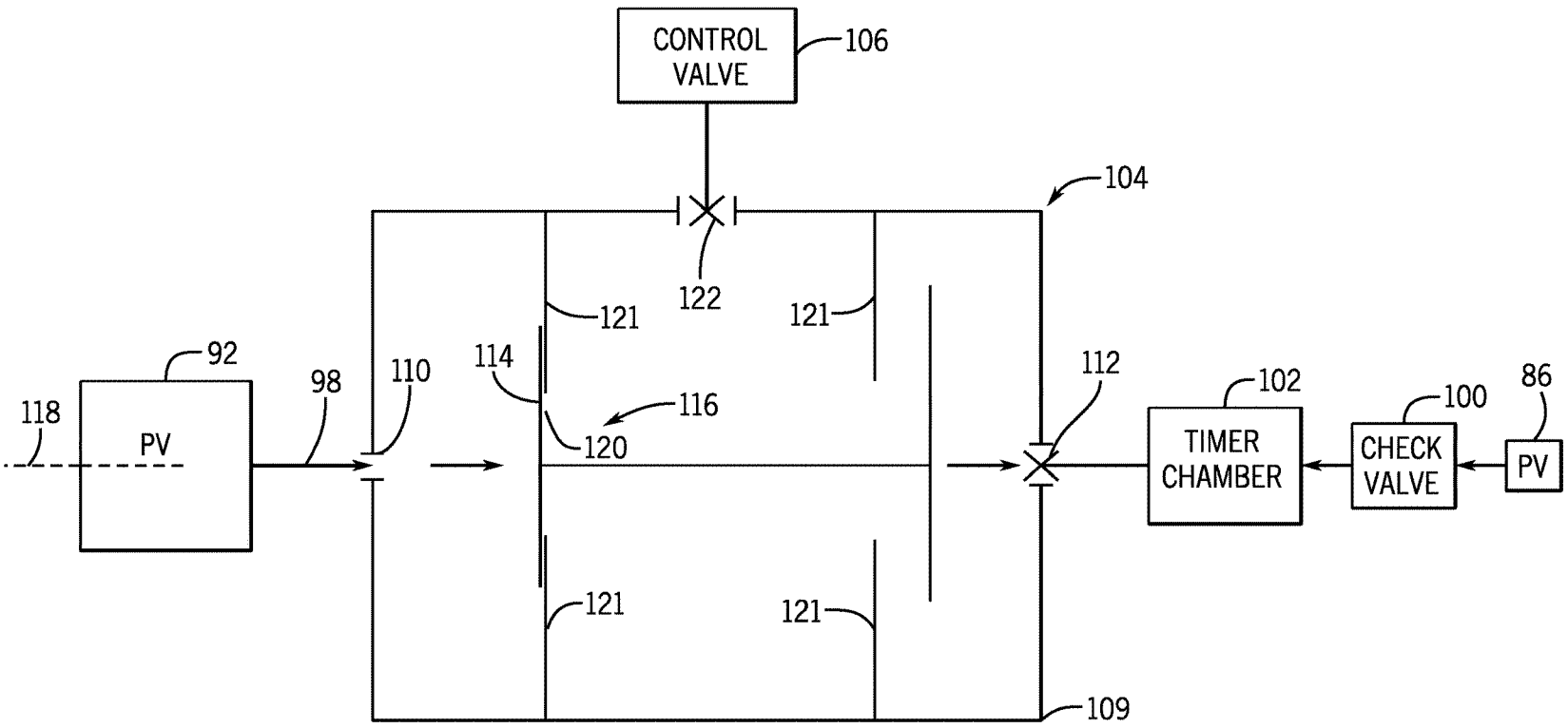
FIG. 4 is a schematic cross-sectional view of an embodiment of a signal valve of the runaway valve system of FIG. 3, with the signal valve in a first position.

FIG. 4 is a schematic cross-sectional view of an embodiment of the signal valve 104 in which the lower chamber valve 92 is outputting the lower chamber signal 98 into the signal valve 104. As shown, the signal valve 104 includes a housing 109 having a first signal valve inlet 110 coupled to the lower chamber valve 92 and a second signal valve inlet 112 coupled to the upper chamber valve 86. In the illustrated embodiment, the second signal valve inlet 112 is closed, as represented by the "X." As used herein, a closed port represented by the "X" may refer to a closed valve at the port, a check valve at the port, a selective blockage at the port, or any other suitable method for blocking flow through a port. The lower chamber signal 98 is configured to enter the signal valve 104 and interact with a first end 114 of a slide 116. The slide 116 may be configured to move (e.g., translate) along a signal valve axis 118 in response to pressure changes (e.g., force) from the lower chamber signal 98 and the upper chamber signal 96. As shown, the pressure (e.g., air pressure) from the lower chamber signal 98 drives the first end 114 of the slide 116 against a first opening 120 (e.g., against stops 121), thereby blocking flow through a signal valve outlet 122, as represented by the "X." In other words, the flow path between the first signal valve inlet 110 and the signal valve outlet 122 is blocked by the first end 114. In this position, the control valve 106 operates under a normal operating state (e.g., upstroke and downstroke of the motor section 14). While the illustrated embodiment includes the first signal valve inlet 110 at one end of the signal valve 104 and the second signal valve inlet 112 at an opposite end of the signal valve 104, it should be appreciated that other configurations of the signal valve inlets and outlet 110, 112, 122, may be utilized.

Figure 5:
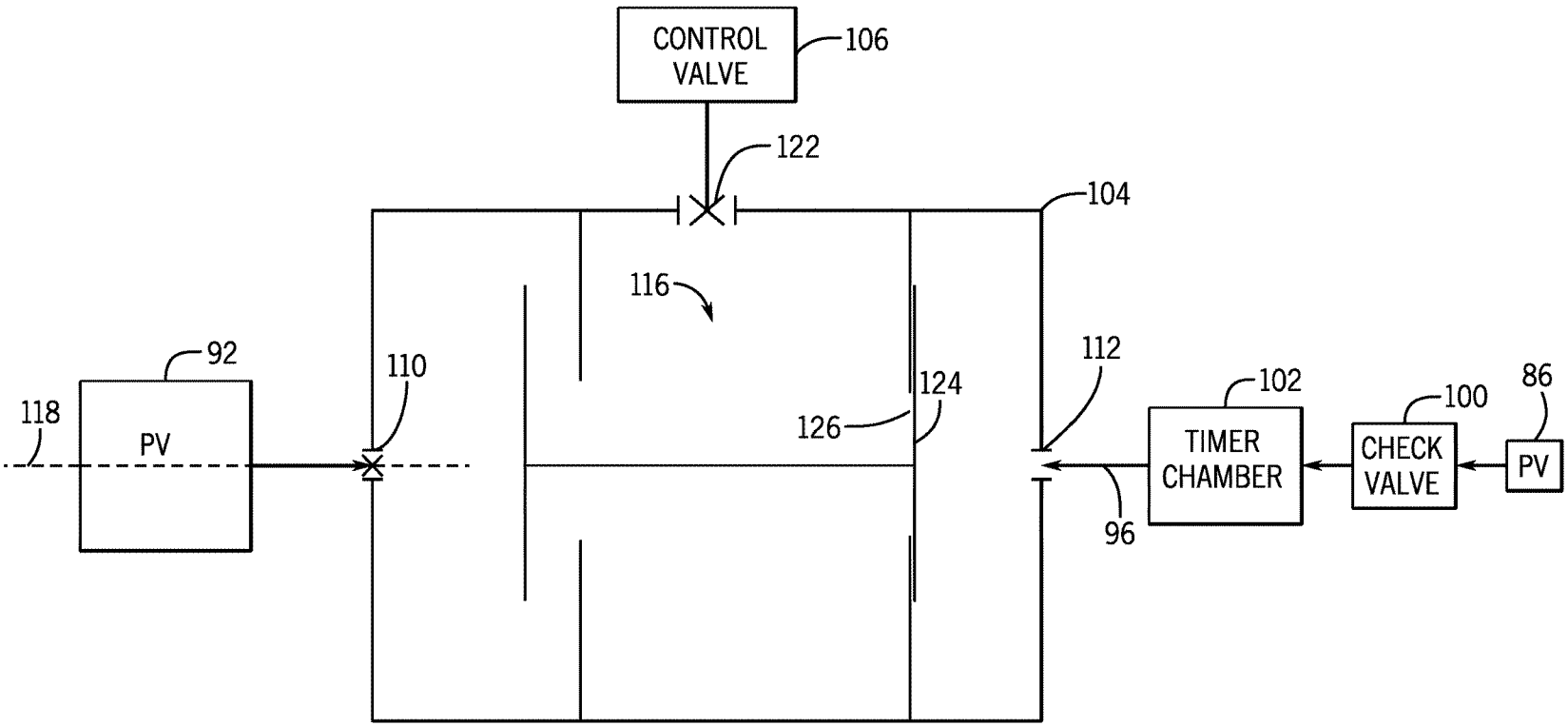
FIG. 5 is a schematic cross-sectional view of an embodiment of the signal valve of FIG. 3, with the signal valve in a second position.

FIG. 5 is a schematic cross-sectional view of an embodiment of the signal valve 104 in which the upper chamber valve 86 is outputting the upper chamber signal 96 into the signal valve 104. Moreover, the first signal valve inlet 110 is closed, as represented by the "X." For example, the first signal valve inlet 110 may include a check valve that blocks flow toward the signal valve 104 unless the pressure in the line is sufficient to overcome a bias in the check valve. As shown, the upper chamber signal 96 (e.g., a volume of air) enters the signal valve 104 through the second signal valve inlet 112. The pressure resulting from the upper chamber signal 96 drives a second end 124 of the slide 116 against a second opening 126, thereby blocking flow through the signal valve outlet 122. Accordingly, the upper chamber signal 96 is isolated in the signal valve 104 and normal operating state of the control valve 106 may resume. As used herein, normal operating states refers to operating conditions in which the motor section 14 is supplying the fluid to the spray gun 12.

Figure 6:
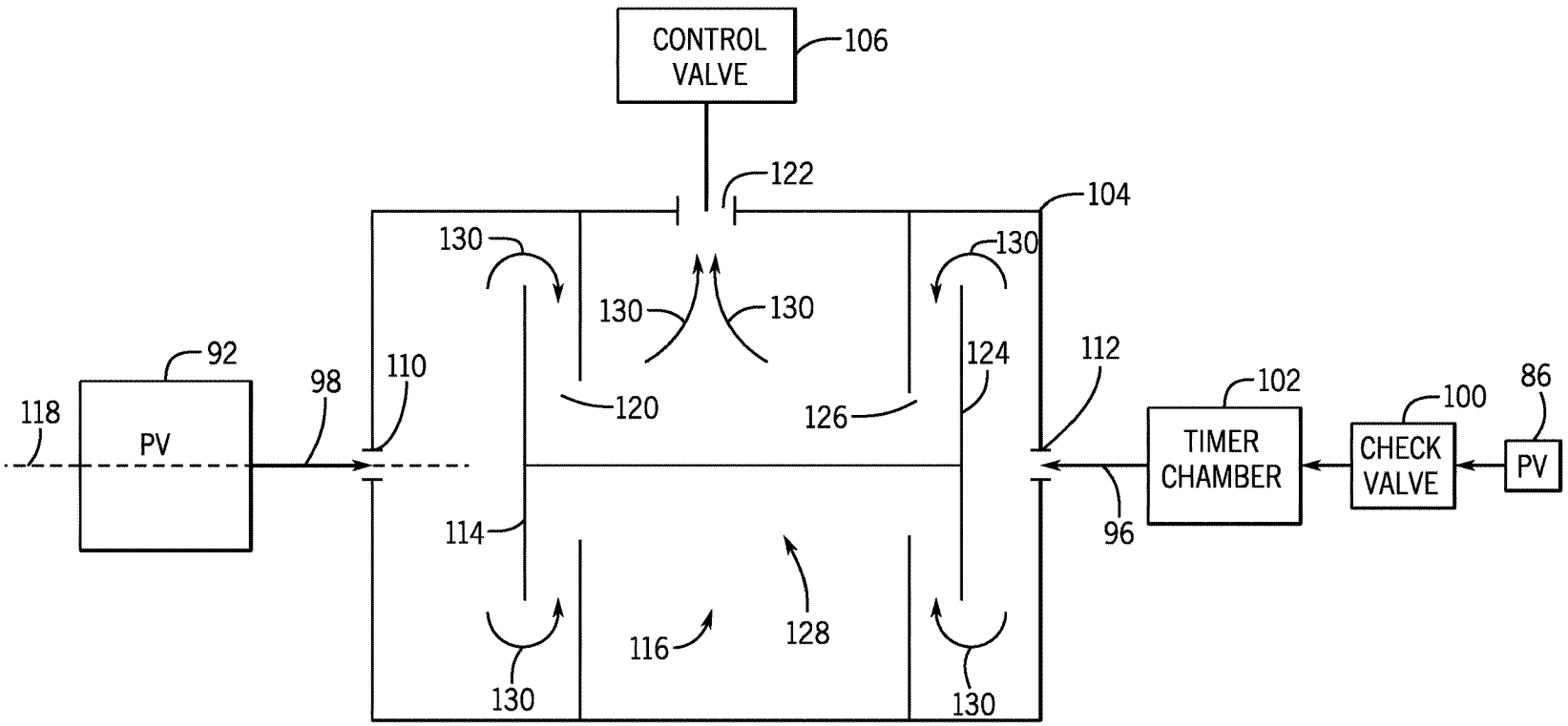
FIG. 6 is a schematic cross-sectional view of an embodiment of the signal valve of FIG. 3, with the signal valve in a third position.

FIG. 6 is a schematic cross-sectional view of an embodiment of the signal valve 104 in which the upper chamber signal 96 and the lower chamber signal 98 are both directed toward the signal valve 104 at the same time. For example, both the upper chamber signal 96 and the lower chamber signal 98 may be directed toward the signal valve 104 while the motor section 14 is operating quickly (e.g., pumping air instead of the coating material, running away), and thereby activating the upper chamber valve 86 and the lower chamber valve 92 rapidly. As shown, the upper chamber signal 96 drives the second end 124 toward the second opening 126 while the lower chamber signal 98 drives the first end 114 toward the first opening 120. However, the force generated by the upper chamber signal 96 may be insufficient to overcome the force generated by the lower chamber signal 98, and vice versa. As a result, neither the first end 114 nor the second end 124 may seal off the respective first opening 120 and second opening 126. Because the first and second openings 120, 126 are not sealed off, the slide 116 is in a substantially balanced position 128. For example, the pressure from the signals 96, 98 may not be equal, however, the slide 116 may still be in the substantially balanced position 128. Accordingly, in certain embodiments, the balanced position 128 may represent the slide 116 in a position such that flow toward the signal valve outlet 122 is enabled. Accordingly, the upper chamber signal 96 and the lower chamber signal 98 may flow through the signal valve 104 at the same time and out of the signal valve outlet 122, as illustrated by the arrows 130. Moreover, in certain embodiments, the signal 96, 98 having the high pressure may flow through the signal valve 104 and out of the signal valve outlet 122. As will be described below, the signal 96, 98 that exits the signal valve 104 through the signal valve outlet 122 is a runaway signal. In other words, the flow paths between the first and second signal valve inlets 110, 112 and the signal valve outlet 122 unblocked, enabling flow through the signal valve. It is appreciated that while the force exerted by the upper and lower chamber signals 96, 98 is substantially equal, that the signal valve outlet 122 may direct the runaway signal 108 toward the control valve 106. In the illustrated embodiment, the runaway signal 108 is a combination of the upper chamber signal 96 and the lower chamber signal 98. In other words, the runaway signal 108 is a volume of air that activates the control valve 106 to block continued operation of the motor section 14.

Figure 7:
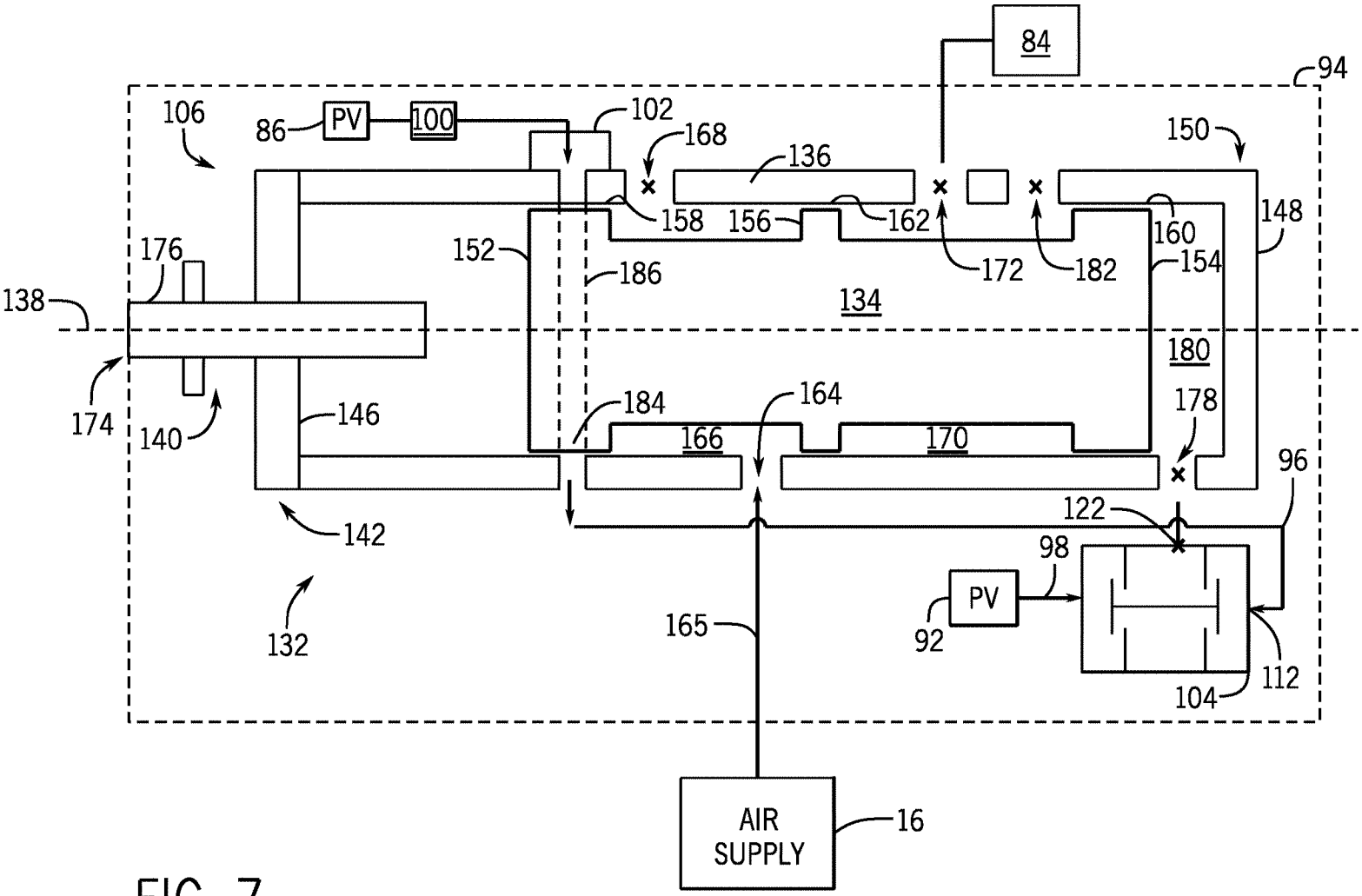
FIG. 7 is a schematic cross-sectional view of an embodiment of a control valve of the runaway valve system of FIG. 3, in which the control valve is in a normal operating position.

FIG. 7 is a schematic cross-sectional view of the control valve 106 in a normal operating state 132. The control valve 106 includes a spool 134 positioned within a sleeve 136. The spool 134 is configured to move along a valve axis 138 between the normal operating state 132 and a runaway state. As will be described below, movement of the spool 134 along the valve axis 138 activates different flow passages within the control valve 106. In the illustrated embodiment, the control valve 106 includes a reset switch 140 at a first valve end 142. The reset switch 140 is configured to reset the position of the spool 134 after detection of a runaway state. In other words, the reset switch 140 is configured to return the control valve 106 to the normal operating state 132 after the control valve 106 has been driven to the runaway state.

In the illustrated embodiment, the control valve 106 includes a first magnet 146 positioned at the first valve end 142 and a second magnet 148 positioned at a second valve end 150, opposite the first valve end 142. For example, the first and second magnets 146, 148 may be rare earth magnets, ferrous magnets, electromagnets, or the like. In certain embodiments, the spool 134 is formed from a metallic material (e.g., metals) that is attracted to the first and second magnets 146, 148. For example, the second magnet 148 at the second valve end 150 may pull the spool 134 toward the second valve end 150 via magnetic attraction, thereby holding the control valve 106 in the normal operating state 132. In this manner, the second magnet 148 acts as a detent to position the spool 134 in the normal operating state 132, unless overcome by another force (e.g., the runaway signal 108). While the illustrated embodiment includes the magnets 146, 148, other detents may be utilized to position the spool 134 of the control valve 106. For example, pneumatic pressure, mechanical connectors (e.g., latches, locks, etc.), or the like may be utilized to block and/or enable movement of the spool 134.

As shown in FIG. 7, the spool 134 includes a first spool end 152, a second spool end 154, and a separator 156. The first spool end 152 is positioned opposite the second spool end 154 such that the first spool end 152 is closer to the first valve end 142 and the second spool end 154 is closer to the second valve end 150. Moreover, the separator 156 is positioned between the first spool end 152 and the second spool end 154. As shown, an outside edge 158 (e.g., outer circumference) of the first spool end 154 is substantially equal to an outside edge 160 (e.g., outer circumference) of the second spool end 154 and an outside edge 162 (e.g., outer circumference) of the separator 156 (e.g., annular ring). That is, the radial extend of the outside edges 158, 160, 162 is substantially the same. The outside edges 158, 160, 162 are configured to contact the sleeve 136 to substantially block flow through the sleeve 136 along the valve axis 138. In other words, the outside edges 158, 160, 162 are configured to separate the sleeve 136 into chambers defined by the first spool end 152, the second spool end 152, and the separator 156. Moreover, in certain embodiments, seals may be positioned between the spool 134 and the sleeve 136 to substantially block flow around the outside edges 158, 160, 162. As will be appreciated, movement of the spool 134 along the valve axis 138 may adjust the position of the first spool end 152, the second spool end 154, and the separator 156 to enable flow to different portions of the control valve 106. While the illustrated embodiment includes the spool 134 has a solid piece configured to move within the sleeve 136, in other embodiments the spool 134 may be a diaphragm, poppet, or the like.

In the illustrated embodiment, the control valve 106 is an X/Y valve (e.g., a valve having X ports and Y positions). For example, the X/Y valve may be a 5/2 valve, a 3/2 valve, a 4/2 valve, or any other suitable valve capable of operating in at least two different operating positions. A first port 164 is configured to receive an air flow 165 (e.g., from the air supply 16 or from an alternative air supply) into a first cavity 166 defined by the first spool end 154 and the separator 156. In certain embodiments, the first cavity 166 may be an annular cavity extending about the spool 134. As shown, the first cavity 166 is fluidly coupled to a second port 168, which is closed as represented by the "X". In other words, the air flow 165 does not flow out of the second port 168 from the first cavity 166. Moreover, a second cavity 170 is defined by the separator 156 and the second spool end 154. In the illustrated embodiment, the second cavity 170 includes a third port 172 coupled to the main air valve 84. As will be described below, while in the runaway state, the first port 164 is positioned in the second cavity 170, thereby enabling the air flow 165 to flow to the main air valve 84. However, as shown in FIG. 7, the air flow 165 from the first cavity 166 is substantially blocked from entering the second cavity 170 by the separator 156. Therefore, the third port 172 is closed, as represented by the "X". In other words, the third port 172 is not distributing the air flow 165 to the main air valve 84, thereby enabling the motor section 14 to continue to operate in the normal operating state 132.

Furthermore, in the illustrated embodiment, the reset switch 140 is in a deactivated position 174. While in the deactivated position 174, the reset switch 140 is not in contact with the first spool end 152. However, in other embodiments, the first spool end 152 may contact the reset switch 140 in the deactivated position 174. Moreover, an indicator 176 of the reset switch 140 is substantially flush with the housing 94. Accordingly, an operator visually inspecting the runaway valve system 90 may deduce that the pumping system 10 is not in a runaway state because the indicator 176 is substantially flush with the housing 94. As will be described below, when the indicator 176 is spaced a distance from the housing 94 (e.g., above the housing, laterally extending away from the housing, etc.), then the indicator 176 shows that the runaway valve system 90 is in the runaway state. The reset switch 140 is configured to move along the valve axis 138 via contact with the first spool end 152.

In the illustrated embodiment, a fourth port 178 is coupled to the signal valve outlet 122. However, because the signal valve 104 is not in the balanced position 128 (e.g., the runaway position), there is no air flow (e.g., the runaway signal 108) from the signal valve outlet 122 directed toward the control valve 106. Accordingly, the fourth port 178 is substantially blocked in the illustrated embodiment, as represented by the "X". For example, the conduit coupled to the fourth port 178 may include a check valve that blocks flow toward the fourth port 178 while the pressure in the conduit is insufficient to overcome a bias force of the check valve. However, in a runaway state, the fourth port 178 receives the air flow from the signal valve 104, because the signal valve 104 is in the substantially balanced position 128.

The control valve 106 may also include additional ports that may be configured to receive and/or send air flows to a variety of components. For example, a fifth port 182 may be positioned within the second cavity 170. Furthermore, a sixth port 184 is configured to couple the timer chamber 102 to the second signal valve inlet 112. For example, the first spool end 152 may include a passage 186 to enable the upper chamber signal 96 to pass through the control valve 104 while the spool 134 is in the normal operating state 132. As a result, the runaway valve system 90 monitors the operating state of the motor section 14 while the control valve 104 is in the normal operating state 132, because the control valve 104 receives the runaway signal 108 while the motor section 14 is in a runaway state.

Figure 8:
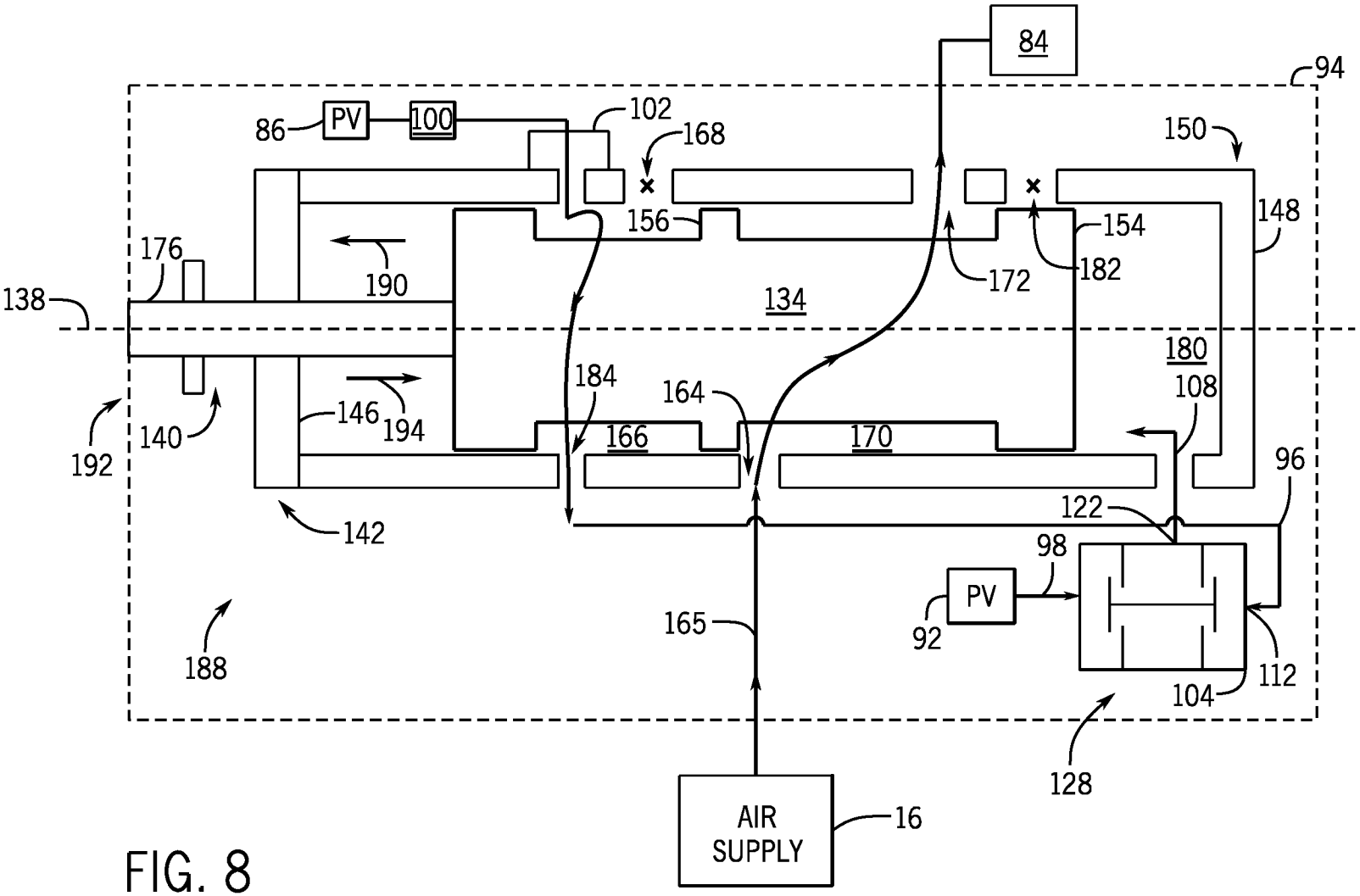
FIG. 8 is a schematic cross-sectional view of an embodiment of the control valve of FIG. 3, in which the control valve is in a runaway position.

FIG. 8 is a schematic cross-sectional view of an embodiment of the control valve 106 in a runaway state 188. As shown, the spool 134 has moved in a first axial direction 190 along the valve axis 138. The runaway signal 108 from the signal valve outlet 122 (e.g., the upper chamber signal 96 and the lower chamber signal 98) is configured to generate sufficient force to overcome the magnetic attraction between the second spool end 154 and the second magnet 148. Accordingly, the spool 134 is driven in the first axial direction 190 such that the magnetic attraction between the first spool end 152 and the first magnet 146 substantially locks the spool 134 in the runaway state 188. Furthermore, as a result of the spool 134 moving in the first axial direction 190, the first spool end 152 drives the indicator 176 in the second direction 190 to an activated position 192, such that the indicator 176 is no longer substantially flush with the housing 94. In this manner, the indicator 176 may provide a visual indication to the operator that the control valve 106 is in the runaway state 188. As will be appreciated, the operator may drive the indicator 176 in a second axial direction 194, thereby overcoming the magnetic attraction between the first magnet 146 and the first spool end 152, to transition the control valve 106 back to the normal operating state 132.

In the illustrated embodiment, the second cavity 170 is fluidly coupled to the first port 164 due to the movement of the spool 134 in the second direction 190. As a result, the air flow 165 is configured to exit the control valve 106 via the third port 172. In the illustrated embodiment, the third port 172 directs the air flow 165 toward the main air valve 84. As a result, the air flow 165 may lock the main air valve 84 into a position that blocks distribution of the air from the air supply 16 to the motor section 14. As a result, the motor section 14 may move to the downstroke position to reduce the possibility of coating material from drying proximate to the rod seals 34. Accordingly, by redirecting the airflow, the control valve 106 blocks movement of the motor section 14, via the main air valve 84, until the control valve 106 is reset via the reset switch 140.

As described in detail above, the runaway valve system 90 is configured to monitor operation of the motor section 14 to determine whether the motor section 14 begins to operate in the runaway state. For example, the runaway valve system 90 may receive the upper and lower chamber signals 96, 98 to monitor the stroke position of the piston 22. During the runaway state 188, the motor section 14 may pump faster than the normal operating state (e.g., less time between the upstroke and the downstroke). The upper and lower chamber signals 96, 98 are distributed to the signal valve 104. While the upper and lower chamber signals 96, 98 operate on the signal valve 104 within the time limit dictated by the timer chamber 102, the signal valve 104 outputs the runaway signal 108 to the control valve 106. As a result, the control valve 106 moves to the runaway state 188, thereby directing the air flow 165 to the main air valve 84 and blocking continued operation of the motor section 14.

As described in detail above, the runaway valve system 90 includes the signal valve 104 configured to receive signals from the upper and lower chamber valves 86, 92 positioned on the motor section 14. The signal from the upper chamber valve 86 is fluidly coupled to the forth check valve 100 and the timer chamber 102. In certain embodiments, the timer chamber 102 includes the orifice configured to release the signal from the upper chamber valve 86 in a predetermined period of time. Furthermore, the timer chamber 102 directs the signal to the signal valve 104. Moreover, the signal from the lower chamber valve 92 is directed toward the signal valve 104. The signal valve 104 is configured to block flow from the signal valve outlet 122 while receiving only one of the signals from either the upper chamber valve 86 or the lower chamber valve 92. However, while receiving signals from both the upper chamber valve 86 and the lower chamber valve 92, the signal valve 104 outputs the runaway signal 108 to the control valve 106. In certain embodiments, the control valve 106 is configured to block operation of the motor section 14 after receiving the runaway signal 108. For example, the runaway signal 108 may drive the spool 134 within the control valve 106 to the runaway state 188, thereby enabling flow from the control valve 106 to the main air valve 84. The main air valve 84 may block further operation from the motor section 14 upon receiving the flow from the control valve 106.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. A pumping system, comprising:

a pump comprising a fluid section coupled to a motor section having a piston, wherein the piston is configured to axially reciprocate within a body, wherein an axial movement of the piston activates a first chamber valve at a first position and a second chamber valve at a second position, and the first and second position are axially offset from one another along a path of the axial movement of the piston;

a main valve configured to direct a flow to the motor section of the pump to facilitate the axial movement of the piston such that the fluid section transfers a fluid from a reservoir to a spray applicator; and a runaway valve system fluidly coupled to the main valve and configured to detect a runaway state of the pump, wherein the runaway valve system comprises a signal valve configured to receive a first chamber signal from the first chamber valve and to receive a second chamber signal from the second chamber valve, and wherein the runaway valve system is configured to direct the main valve to control the flow to the motor section to hold a position of the piston to stop operation of the pump in response to detection of the runaway state.

2. The system of claim 1, comprising a control valve fluidly coupled to the signal valve, wherein the control valve is configured to receive a runaway signal from the signal valve indicative of the runaway state.

3. The system of claim 2, wherein the control valve transmits a stop signal directing the main valve to stop operation of the pump after receiving the runaway signal from the signal valve.

4. The system of claim 2, wherein the signal valve comprises:

a first opening;

a second opening; and a slide positioned between the first and second openings, wherein the slide comprises a first end configured to substantially block the first opening and a second end, configured to substantially block the second opening, wherein the second end is opposite from the first end.

5. The system of claim 4, wherein the signal valve is configured to direct the runaway signal to the control valve while the second chamber signal is acting on the first end of the slide and while the first chamber signal is acting on the second end of the slide.

6. The system of claim 4, wherein the signal valve is configured to block flow to a signal valve outlet while only the second chamber signal is acting on the first end or only the first chamber signal is acting on the second end.

7. A runaway valve system, comprising:

a housing;

a signal valve positioned within the housing, wherein the signal valve is configured to receive a first signal from a pump comprising a piston, wherein the first signal is indicative of a first piston position of the piston of the pump, and wherein the signal valve is configured to receive a second signal from the pump indicative of a second piston position of the piston of the pump; and a control valve configured to receive a third signal from the signal valve indicative of a runaway state, and to output a fourth signal to a main air valve while the control valve is in a runaway state.

8. The runaway valve system of claim 7, wherein the control valve is an X/Y valve, wherein X is a number of ports, Y is a number of operating positions, and X is greater than or equal to 3, and Y is greater than or equal to 2.

9. The runaway valve system of claim 7, wherein the control valve comprises a spool configured to move between a normal operating state in which the control valve does not receive the third signal from the signal valve and the runaway state in which the control valve receives the third signal from the signal valve.

10. The runaway valve system of claim 9, wherein the control valve comprises:

at least one detent configured to hold the spool in the normal operating state until the control valve receives the third signal from the signal valve.

11. The runaway valve system of claim 7, wherein the fourth signal is a volume of air directed toward the main air valve configured to block operation of the main air valve.

12. The runaway valve system of claim 7, wherein the control valve comprises a reset switch configured to move the control valve from the runaway state to a normal operating state.

13. The runaway valve system of claim 12, wherein the reset switch comprises an indicator that is substantially flush with the housing while the control valve is in the normal operating state, and the indicator extends away from the housing while the control valve is in the runaway state.

14. A pumping system, comprising:

a pneumatic pump configured to pump a fluid from a reservoir to a spray applicator;

an air supply configured to output a first volume of air;

a main valve configured to receive the first volume of air from the air supply and to distribute the first volume of air to the pneumatic pump to enable axial reciprocation within a body to control operation of the pneumatic pump; and a runaway valve system configured to receive a first signal from the pneumatic pump indicative of a first axial position of the pneumatic pump and a second signal from the pneumatic pump indicative of a second axial position of the pneumatic pump, wherein the runaway valve system comprises a signal valve configured to receive the first signal from a first chamber valve and to receive the second signal from a second chamber valve, and wherein the runaway valve system determines if the pneumatic pump is operating in a runaway state, and stops operation of the pneumatic pump if the pneumatic pump is operating in the runaway state.

15. The system of claim 14, wherein the pneumatic pump comprises a pump housing, the main valve comprises a main valve housing, and the runaway valve system comprises a runaway valve system housing, and the pump housing, the main valve housing, and runaway valve system housing are configured to couple together, and the runaway valve system housing is positioned between the pump housing and the main valve housing.

16. The system of claim 14, wherein the runaway valve system comprises:

a timer chamber configured to receive the second signal, the signal valve positioned downstream of the timer chamber and configured to produce a third signal if the first and second signals indicate the pneumatic pump is operating in the runaway state; and a control valve configured to receive the third signal from the signal valve and to output a fourth signal to the main air valve to stop operation of the pneumatic pump.

17. The system of claim 16, wherein the air supply is configured to output a second volume of air and is configured to direct the second volume of air to the control valve, wherein the second volume of air is the fourth signal.

18. The system of claim 16, wherein a continuous volume of air is distributed to the pneumatic pump to block further movement of the pneumatic pump.

* * * * *